US005589435A

United States Patent [19]

Ito et al.

[11] Patent Number: 5,589,435

[45] Date of Patent: *Dec. 31, 1996

[54] SHEET CAPABLE OF RELEASING A THERMAL TRANSFER IMAGE-RECEIVING LAYER, A METHOD FOR TRANSFERRING A THERMAL TRANSFER IMAGE-RECEIVING LAYER FROM THE SHEET AND A METHOD FOR FORMING IMAGES

[75] Inventors: Kengo Ito, Miyagi; Kaori Isaji, Chiba; Yoshio Fujiwara, Tochigi; Mitsuhiro Isogai; Masanobu Hida, both of Tokyo, all of Japan

[73] Assignee: Sony Corporation, Tokyo, Japan

[ * ] Notice: The term of this patent shall not extend beyond the expiration date of Pat. No. 5,446,012.

[21] Appl. No.: 471,767

[22] Filed: Jun. 6, 1995

Related U.S. Application Data

[63] Continuation of Ser. No. 242,418, May 13, 1994, Pat. No. 5,446,012.

[30] Foreign Application Priority Data

May 19, 1993 [JP] Japan ..... 5-141585

[51] Int. Cl.[6] ..... B41M 5/035; B41M 5/38

[52] U.S. Cl. ..... 503/227; 428/195; 428/331; 428/913; 428/914

[58] Field of Search ..... 8/471; 428/195, 428/331, 913, 914; 503/227

[56] References Cited

U.S. PATENT DOCUMENTS

| | | | |
|---|---|---|---|
| 5,006,502 | 4/1991 | Fujimura et al. | 503/227 |
| 5,260,256 | 11/1993 | Takahara et al. | 503/227 |
| 5,446,012 | 8/1995 | Ito et al. | 503/227 |

FOREIGN PATENT DOCUMENTS

| | | | |
|---|---|---|---|
| 0506034A1 | 7/1992 | European Pat. Off. | 503/227 |

*Primary Examiner*—B. Hamilton Hess

*Attorney, Agent, or Firm*—Hill, Steadman & Simpson

[57] ABSTRACT

A sheet of the type which comprises a release base sheet and a thermal transfer image-receiving layer formed on the release base sheet and which is capable of releasing the thermal transfer image-receiving layer from the base sheet is described. The receiving layer is made of a dispersion, in a resin binder, of a layer compound capable of fixing cationic dyes through ion exchange reaction therewith. The receiving layer can be readily formed on a desired type of substrate by superposing the receiving layer on the substrate, after which the release base sheet is peeled off from the receiving layer. A thermal transfer image can be formed on the receiving layer by superposition with an ink ribbon containing a cationic dye and application of image information to the ink ribbon or by re-transfer of a cationic dye image from a printing paper. The thermal transfer image may be formed prior to the transfer of the receiving layer on the substrate. Owing to the fixing of the cationic dye through ion exchange reaction, the fixing properties of the dye in the receiving layer can be significantly improved.

10 Claims, 9 Drawing Sheets

SHEET CAPABLE OF RELEASING A THERMAL TRANSFER IMAGE-RECEIVING LAYER, A METHOD FOR TRANSFERRING A THERMAL TRANSFER IMAGE-RECEIVING LAYER FROM THE SHEET AND A METHOD FOR FORMING IMAGES

This is a continuation, of application Ser. No. 08/242,418, filed May 13, 1994, now U.S. Pat. No. 5,446,012.

BACKGROUND OF THE INVENTION

This invention relates to a sheet capable of releasing a thermal transfer image-receiving layer wherein an image receiving layer on which thermal transfer images have been formed or are to be formed according to thermal transfer recording systems, particularly, according to sublimation thermal transfer systems, is released and transferred on various types of substrates such as polyvinyl chloride sheets or cards and plain cotton cloth sheets. The invention also relates to a method for transferring a thermal transfer image receiving layer and an image-forming method using the release and transfer sheet.

Sublimation transfer recording techniques have wide utility in the fields where video image information is fixed, as a thermal transfer image, on an image-receiving layer of a material to be transferred. The material to be transferred which is ordinarily employed is a printing sheet including a substrate and an image-receiving layer capable of receiving dye images thereon. Using this type of printing sheet, the thermal transfer image is formed by procedures wherein the ink layer of an ink ribbon having thermally diffusable dyes such as disperse dyes therein is superposed on the image-receiving layer of the material to be transferred and heated by heating means, such as a thermal head, in accordance with image information, thereby causing the dye in the ink layer to be transferred to the image-receiving layer.

Recently, the images thermally transferred by the sublimation thermal transfer techniques have been formed on various types of materials or substrates. For instance, typical of such a material is a polyvinyl chloride card (hereinafter referred to simply as PVC card) which has an image-receiving layer consisting of polyvinyl chloride. The thermal transfer image is formed directly on the image-receiving layer of the PVC card.

Further, attempts have been made wherein a thermal transfer image has been once formed on an ordinary printing sheet which has, on a substrate, an image-receiving layer made of thermoplastic resins and the thus formed image is re-transferred on a plain cloth such as of cotton. In the case, an adhesive sheet made of a thermoplastic resin is sandwiched between the cloth and the image-receiving layer of the printing sheet, followed by hot pressing by use of a warm iron and peeling off the substrate of the printing sheet to re-transfer the image-receiving layer on the cloth. Alternatively, the dye image alone on the image-receiving layer may be re-transferred to an adhesive sheet sandwiched between the cloth and the printing sheet, followed by peeling off the printing sheet to permit the thermal transfer image to be re-transferred on the cloth.

However, when the image-receiving layer on the PVC card on which the thermal transfer image has been formed is brought into contact with materials having large mounts of plasticizers therein, e.g. artificial leathers, soft vinyl chloride sheets, plastic erasers and the like, over a long time, the dye of the thermal transfer image formed on the image-receiving layer is at least partially re-transferred to the material, thereby presenting the problem that the thermal transfer image is damaged. Additionally, ordinarily employed disperse dyes are soluble in organic solvents such as toluene, ethanol and the like. When the image-receiving layer is contacted with such solvents as mentioned above, the dye is dissolved out from the image-receiving layer. This eventually brings about the thermal transfer image being impeded.

On the other hand, with the case of the cloth on which a thermal transfer image has been re-transferred, when the cloth is subjected to dry cleaning, the dye is dissolved out in solvents for the dry cleaning, thus impeding the image on the cloth. With the cloth where a dye image alone is re-transferred to its adhesive layer, dyes have to be used in larger amounts since known disperse dyes are not satisfactory with respect to the transfer efficiency thereof.

Now, there is a demand for readily fixing, as a still image, video information images on various types of substrates other than printing sheets.

SUMMARY OF THE INVENTION

It is accordingly an object of the invention to provide a sheet capable of releasing an image-receiving layer therefrom after or prior to formation of an intended thermal transfer image and which can solve the problems involved in the prior art counterparts.

It is another object of the invention to provide a sheet having an image-receiving layer whose dye fixing properties are significantly improved and which can be readily released and transferred to various types of substrates such as PVC cards, cloths and the like after or prior to formation of thermal transfer images.

It is a further object of the invention to provide a method for transferring an image-receiving layer from a sheet of the type mentioned above to an intended type of substrate after or prior to formation of an imagewise pattern on the image-receiving layer.

It is a still further object of the invention to provide a method for forming images on an image-receiving layer of a sheet of the type mentioned above.

We have found that when an image-receiving layer having therein a layer compound having the cation exchangeability is used and a thermal transfer image made of cationic dyes is formed on or in the image-receiving layer, the cationic dye image can be fixed through ion exchange with the layer compound. The resultant image-receiving layer bearing the dye image thereon is transferred to other substrates such as PVC cards thereby achieving the objects of the invention. The term "layer compound" used herein and hereinafter is intended to mean a compound having a layer structure as will be described in more detail.

More particularly, according to one embodiment of the invention, there is provided a sheet of the type which comprises a release base sheet and a thermal transfer image-receiving layer formed on the release base sheet and which is capable of releasing the thermal transfer image-receiving layer therefrom, the receiving layer being made of a dispersion, in a resin binder, of a layer compound capable of fixing cationic dyes through ion exchange reaction therewith.

According to another embodiment of the invention, there is also provided a method for transferring a thermal transfer image-receiving layer from a sheet of the type defined above, the method comprising superposing the sheet on a substrate, on which a thermal transfer image is to be formed, in such a way that the image-receiving layer is in face-to-face relation with the substrate, and peeling off the release base sheet from the first-mentioned sheet.

According to a further embodiment of the invention, there is provided a method for forming a thermal transfer image on an image-receiving layer of a sheet of the type defined above, the method comprising superposing a thermal transfer image-receiving layer formed on a substrate by the receiving layer transferring method defined above on an ink layer of a transfer material containing a cationic dye therein, selectively heating the transfer material according to image signals thereby causing the cationic dye in the transfer material to the image-receiving layer in an imagewise pattern whereby the cationic dye is fixed in the image-receiving layer through ion exchange reaction with the layer compound contained in the image-receiving layer.

According to a still further embodiment of the invention, there is provided a method for forming a thermal transfer image which comprises providing a thermal transfer image-receiving layer formed on a substrate by an image-receiving layer transferring method defined above, superposing an image-receiving layer of a transfer sheet, on which a thermal transfer image made of a cationic dye has been previously formed, on the thermal transfer image-receiving layer, and hot pressing the superposed layers to re-transfer the cationic dye image on the thermal transfer image-receiving layer thereby causing the cationic dye image to fix through ion exchange reaction with the layer compound in the thermal transfer image-receiving layer.

According to another embodiment of the invention, there is also provided a method for forming a thermal transfer image, the method comprising providing a sheet having a thermal transfer image-receiving layer of the type defined before, superposing the thermal transfer image-receiving layer with an ink layer of a transfer material which contains a cationic dye therein, selectively heating the transfer material according to image signals thereby causing the cationic dye in the ink layer to be transferred to the thermal transfer image-receiving layer in an imagewise pattern and fixing the resultant cationic dye image through ion exchange reaction with a layer compound in the thermal transfer image-receiving layer, and transferring the fixed dye image-bearing layer to a substrate according to the layer-transferring method defined above.

According to still another embodiment of the invention, there is provided a method for forming a thermal transfer image, the method comprising providing a sheet having a thermal transfer image-receiving layer of the type defined before, superposing the thermal transfer image-receiving layer on an image-receiving layer of a printing sheet, on which a thermal transfer image made of a cationic dye has been formed, selectively hot pressing the superposed layers to re-transfer the cationic dye thermal transfer image to the thermal transfer image-receiving layer wherein the cationic dye thermal transfer image is fixed through ion exchange reaction with the layer compound in the thermal transfer image-receiving layer, and transferring the image-bearing layer to a substrate on which the image is to be formed.

DETAILED DESCRIPTION OF THE INVENTION

Figure 1:
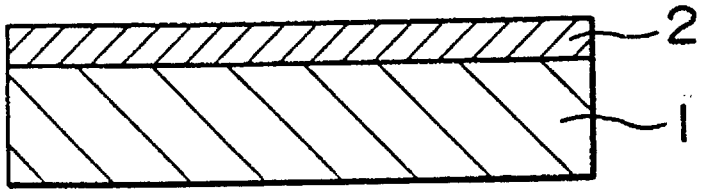
FIG. 1 is a schematic sectional view of a sheet capable of releasing a thermal transfer image-receiving layer therefrom.

The invention is described in detail with reference to the accompanying drawings wherein like reference numerals indicate like members or parts.

FIG. 1 is a sectional view of a sheet from which a thermal transfer image-receiving layer can be released and transferred to intended types of substrates. As shown in the figure, the sheet has a release base sheet 1 and a thermal transfer image-receiving layer 2 formed on the base sheet 1.

The base sheet 1 functions as a support for the image-receiving layer 2. When the layer 2 is released and transferred to other substrates such as PVC cards, the base sheet 1 is peeled off at the interface with the image-receiving layer.

The base sheet 1 which is preferably used is an ordinary polyethylene terephthalate film. Of course, there may be used as the release base sheet white opaque sheets such as pearl bases to which white pigments or pearlescant pigments are added. In this case, the sheet having the thermal transfer image-receiving layer thereon may be used as a printing sheet as it is.

The image-receiving layer 2 is one on which a thermal transfer image is formed. The layer 2 is made of a dispersion of a layer compound dispersed in a resin binder. The layer compound should be capable of fixing cationic dyes through ion exchange reaction therewith.

The layer compounds used in the present invention are those compounds which have ion-exchangeable cations inbetween the layers thereof. Such compounds include those compounds which are set out, for example, in U. S. patent application Ser. No. 858,650. For instance, clay layer compounds having ion exchangeability and, particularly, montmorillonoids of the following formula (1) may be mentioned as preferred $$(X, Y)_{2\sim3}Z_4O_{10}(OH)_{2-m}H_2O\cdot(W_{1/3}) \quad (1)$$

wherein X represents Al, Fe(III), Mn(III) or Co(III), Y represents Mg, Fe(II), Mn(II), Ni, Zn or Li, Z represents Si or Al, W represents K, Na or Ca, $H_2O$ represents intercalated water, and m is an integer.

Specific examples of the montmorillonoids of the formula (1) include, depending on the combination of X and Y and the number of substitutions, natural and synthetic products such as of montmorillonite, magnesian montmorillonite, iron montmorillonite, iron magnesian montmorillonite, beidellite, aluminian beidellite, nontronite, aluminian nontronite, saponite, aluminum saponite, hectorite, sauconite and the like. Moreover, there may be used those compounds of the formula (1) wherein the OH group or groups are substituted with a halogen atom such as a fluorine atom.

Aside from the montmorillonoids of the formula (1), there may be mentioned other types of cationic exchangeable clay compounds including a mica group such as of sodium silicic mica, sodium taeniolite, lithium taeniolite and the like.

The layer compounds should preferably have a satisfactory distance between the layers of the compound so that cationic dyes become more likely to enter the layer structure of the compound whereby the ion exchange reaction readily proceeds. It is also preferred that individual interstices between the layers of the compound are rendered hydrophobic in nature so that the layer compound can be readily dispersed in oleophilic or hydrophobic resin binders. To this end, the cation exchangeable alkali metal cations or alkaline earth metal cations in the layer compound should preferably have been replaced by organic cations which are ion exchangeable with cationic dyes and have oleophilic groups. Preferable examples of such organic cations include alkyl substituted quaternary ammonium ions or substituted phosphonium ions having an alkyl group which has not less than 8 carbon atoms.

In view of the fixing of thermal transfer images and the ease in formation of a thermal transfer image-receiving layer, the amount of the layer compound should preferably be in the range of 10 to 90 wt% of the image-receiving layer as a solid content.

The resin binders may be those resins properly selected from thermoplastic resins and thermosetting resins, which are used in the image-receiving layer of printing sheets ordinarily employed for thermal transfer recording. Preferably, there are used thermoplastic resins, such as polyethylene, polyvinyl chloride and the like, which turn into an adhesive on heating thereof. By this, when heating the thermal transfer image-receiving layer 2, adhesion is imparted thereto, enabling one to transfer the layer 2 to other substrates without use of any adhesive.

Figure 2:
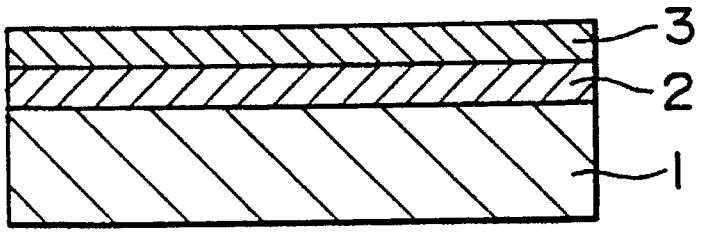
FIG. 2 is a schematic sectional view of a sheet capable of releasing a thermal transfer image-receiving layer therefrom.

As shown in FIG. 2, there may be formed an adhesive layer 3 on the image-receiving layer 2. This arrangement permits easy transfer of the image-receiving receiving layer 2 to other substrates. The adhesive layer 3 may be made of thermoplastic resins, such as polyethylene, polyvinyl chloride and the like, capable of exhibiting adhesiveness on heating or thermosetting adhesives such as epoxy or urethane adhesives.

The cationic dyes which are fixed through ion exchange reaction with the layer compound in the thermal transfer image-receiving layer 2 may include various types of cationic dyes capable of being fixed or held with the layer compound through the ion exchange. Examples include water-soluble dyes such as azo, triphenylmethane, azine, oxazine and thiazine dyes which have, respectively, an amine salt or a quaternary ammonium group. It is preferred that these dyes are subjected to hydrophobic treatment in order to realize rapid ion exchange reaction with a layer compound which is present in a hydrophobic environment. For the hydrophobic treatment, the counter anions of the cationic dyes such as halogen ions are preferably subjected to ion exchange with organic anionic surface active agents having a hydrophobic group, e.g. sulfonates such as alkylbenzenesulfonates, sulfates such as alkylsulfates, carboxylates such as alkyl ether carboxylates, phosphates such as alkylphosphates and the like.

The sheet of the invention capable of releasing a thermal transfer image-receiving layer therefrom can be fabricated by a usual manner. For instance, a composition for the receiving layer is applied onto a release base sheet by a usual manner and dried to obtain the layer-releasing sheet. If necessary, an adhesive composition may be further applied and dried to obtain the sheet of the type shown in FIG. 2.

Then, a method for transferring the thermal transfer image-receiving layer to other substrates such as PVC cards or cloths using the sheet of the invention is described. It will be noted that this method is also within the scope of the invention.

The image-receiving layer transferring method of the invention comprises, as stated hereinbefore, superposing a sheet having an image-receiving layer on a release base sheet on a substrate such as a PVC card or a piece of cloth on which a thermal transfer image is to be formed, in such a way that the image-receiving layer is facing with the substrate, and peeling off the release base sheet from the receiving layer to permit the image-receiving layer to be attached to the substrate. This method is more particularly described with reference to FIGS. 3A to 3C, 4A to 4C and 5A to 5C.

Figure 3A:
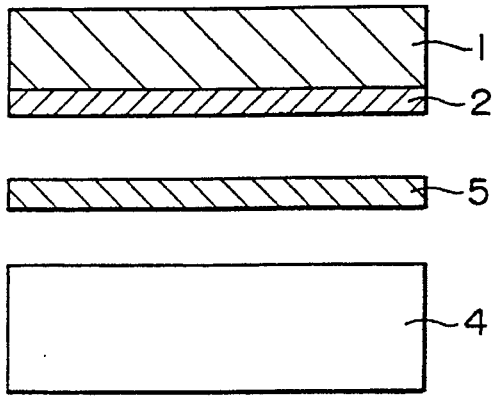
FIGS. 3A, 3B and 3C are, respectively, an illustrative view for a method of transferring a thermal transfer image-receiving layer to other substrates.
Figure 3B:
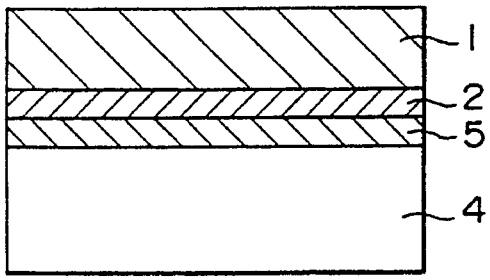
Figure 3C:
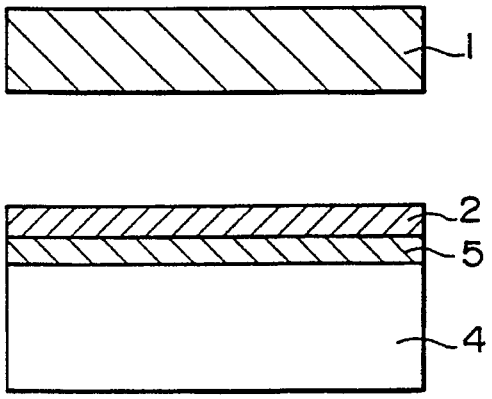

FIGS. 3A to 3C show a procedure of transferring and attaching the image-receiving layer 2 from the layer-bearing sheet to a substrate 4 and fixing the layer 2 on the substrate 4 through a separately provided adhesive sheet 5. The image-receiving layer 2 is provided in face-to-face relation with the substrate 4, between which the adhesive sheet 5 is provided as shown in FIG.3A. The superposed arrangement is then entirely subjected to hot pressing to bond the layer 2 to the substrate 4 through the adhesive sheet 5 as shown in FIG.3B. Finally, the release base sheet 1 is peeled off to transfer the image-receiving layer 2 to the substrate 4.

In the case, the adhesive sheet 5 may be a sheet of a thermoplastic resin such as polyethylene, polyvinyl chloride or the like or a thermosetting resin provided that it exhibits adhesiveness on heating.

Figure 4A:
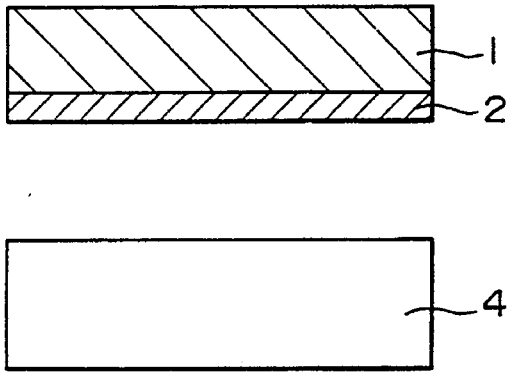
FIGS. 4A, 4B and 4C are, respectively, an illustrative view for another method of transferring a thermal transfer image-receiving layer to other substrates.
Figure 4B:
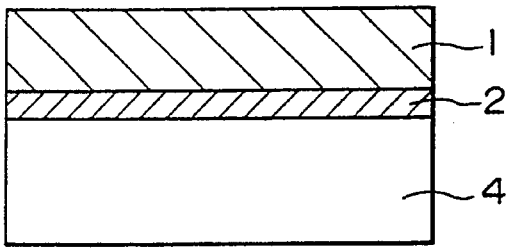
Figure 4C:
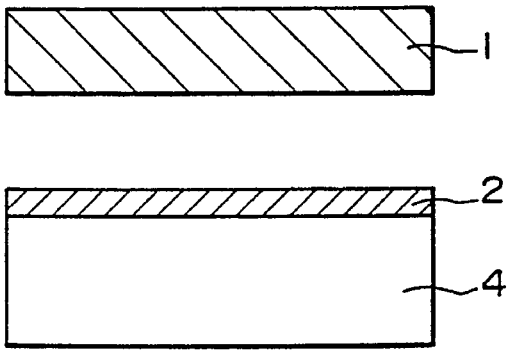

FIGS. 4A to 4C show a procedure of attaching the layer 2 to other substrate 4 wherein the layer 2 has adhesiveness when heated. The image-receiving layer 2 and the substrate 4 are provided in face-to-face relation with each other as shown in FIG. 4A, followed by hot pressing to bond the layer 2 directly to the substrate 4 as shown in FIG. 4B. Finally, the release base sheet I is separated to attach the layer 2 to the substrate 4.

Figure 5A:
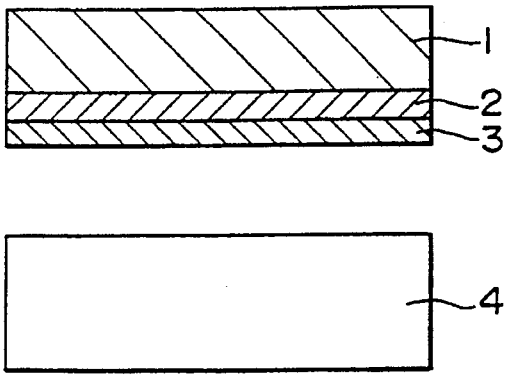
FIGS. 5A, 5B and 5C are, respectively, an illustrative view for a further method of transferring a thermal transfer image-receiving layer to other substrates.
Figure 5B:
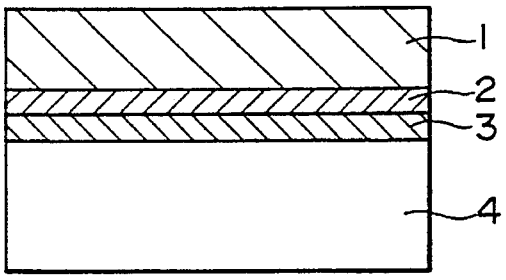
Figure 5C:
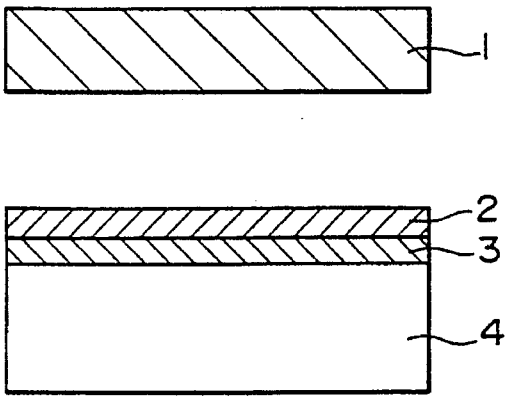

FIGS. 5A to 5C a procedure of attaching the layer 2 to the substrate 4 wherein the transfer sheet is of the type shown in FIG. 2 which has an adhesive layer 3 on the layer 2. The adhesive layer 3 and the substrate 4 are provided in face-to-face relation with each other as shown in FIG. 5A, followed by hot pressing to bond the layer 2 to the substrate 4 through the adhesive layer 3 as shown in FIG. 5B. Finally, the release base sheet 1 is separated to attach the layer 2 to the substrate 4.

Reference is now made to 6A to 6D, 7A to 7D, 8A to 8D and 9A to 9D with which there are illustrated procedures of forming thermal transfer images on substrates, such as PVC cards or cloth sheets, using the image-receiving layer bearing sheet of the invention and the method for transferring the image-receiving layer as set out hereinbefore. As a matter of course, these procedures are also within the scope of the invention.

FIGS. 6A to 6D illustrate a procedure of forming a thermal transfer image according to an embodiment of the invention.

Figure 6A:
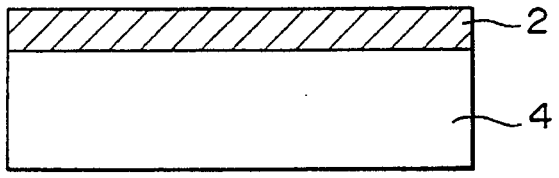
FIGS. 6A, 6B, 6C and 6D are, respectively, an illustrative view for a method of forming a thermal transfer image.
Figure 6B:
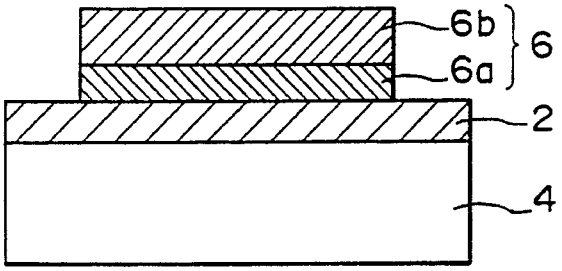

In this embodiment of the invention, a thermal transfer image is directly formed on the thermal transfer image-receiving layer, which is bonded to a substrate from the sheet of FIG. 1, by use of a transfer material such as an ink ribbon. FIG. 6A shows a thermal transfer image-receiving layer 2 formed on a substrate 4 according to any of the procedures illustrated in FIGS. 3A to 3C, 4A to 4C and 5A to 5C. As shown in FIG. 6B, a transfer material 6 which has a cationic dye-containing ink layer *6a* on a support *6b* is superposed on the layer 2. In this figure, any adhesive sheet or layer is not provided between the substrate 4 and the layer 2, but the adhesive layer 3 shown in FIG. 2 or the adhesive sheet 5 shown in FIGS. 3A to 3C may be provided therebetween, if necessary.

Figure 6C:
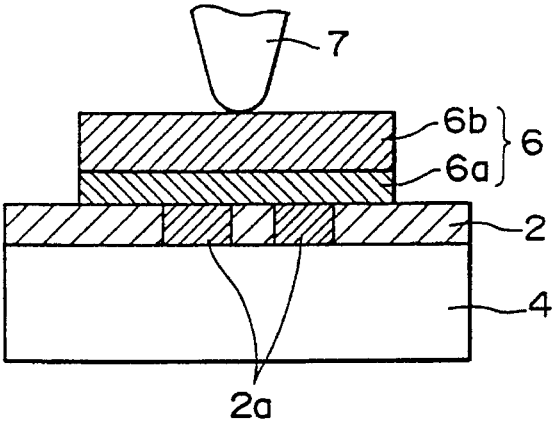

Subsequently, the transfer material 6 is selectively heated by heating means, such as a thermal head 7, according to image signals to transfer a cationic dye of the ink layer *6a* to the receiving layer 2 thereby forming a thermal transfer image *2a* as shown in FIG. 6C. The cationic dye of the transfer image *2a* is held and fixed with the layer compound through ion exchange reaction.

Figure 6D:
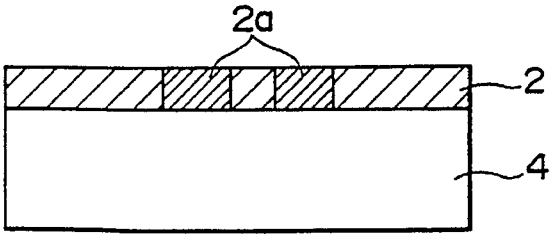

Finally, the transfer material 6 is peeled off from the thermal transfer image-receiving layer 2 to provide the thermal transfer image *2a* fixed on the substrate 4 as shown in FIG. 6D.

FIGS. 7A to 7D show a procedure for forming a thermal transfer image according to another embodiment of the invention.

Figure 7A:
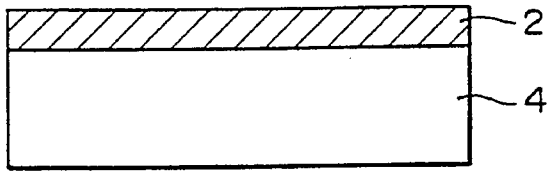
FIGS. 7A, 7B, 7C and 7D are, respectively, an illustrative view for another method of forming a thermal transfer image.
Figure 7B:
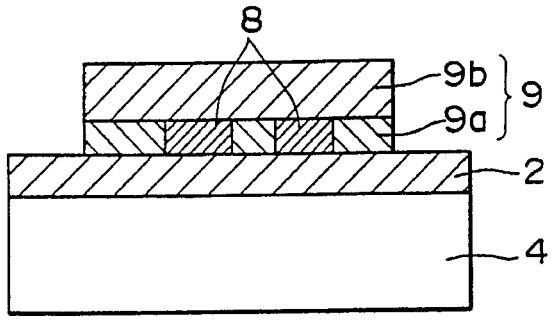

In this embodiment, the thermal transfer image-receiving layer 2 formed on the substrate 4 according to the procedures illustrated in FIGS. 3A to 3C and 4A to 4C, respectively, is first provided and superposed thereon with a printing sheet 9. The printing sheet 9 has a synthetic paper support *9b* and an image-receiving layer *9a* on which a thermal transfer image 8 made of a cationic dye has been previously formed. The superposition is such that the image 8 is facing with the receiving layer 2 as shown in FIG. 7B. If necessary, an adhesive layer 3 as shown in FIG. 2 or an adhesive sheet 5 as shown in FIGS. 3A to 3C may be provided between the substrate 4 and the layer 2 as in the foregoing embodiment.

Figure 7C:
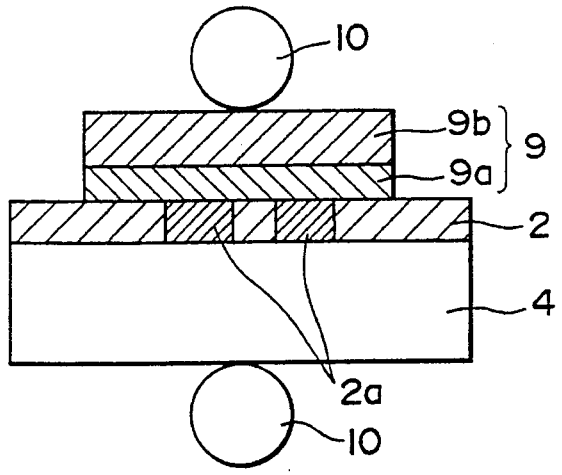

Subsequently, the superposed sheets are hot pressed, for example, by passage between hot rolls 10, so that the cationic dye thermal transfer image 8 is re-transferred from the image-receiving layer *9a* of the printing sheet 9 to the thermal transfer image-receiving layer 2 thereby forming a thermal transfer image *2a* as shown in FIG. 7C. The cationic dye of the thermal transfer image *2a* is held and fixed with the layer compound through ion exchange reaction.

Figure 7D:
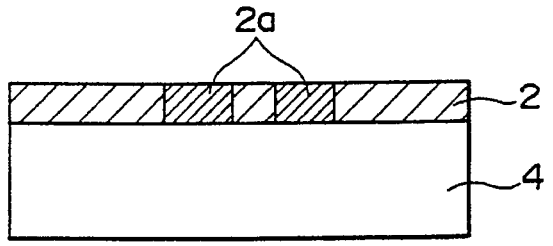

Finally, the printing sheet 9 is separated from the thermal transfer image-receiving layer 2 as shown in FIG. 7D.

FIGS. 8A to 8D schematically show a procedure of forming a thermal transfer image on an intended type of substrate according to a further embodiment of the invention.

Figure 8A:
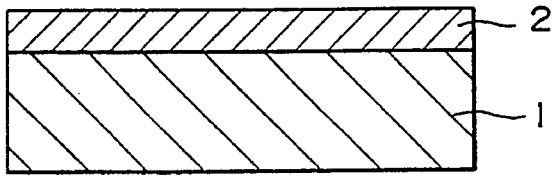
FIGS. 8A, 8B, 8C and 8D are, respectively, an illustrative view for a further method of forming a thermal transfer image.
Figure 8B:
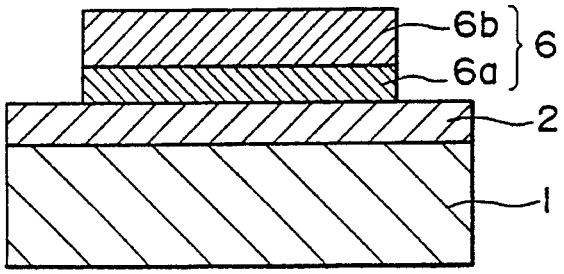

This embodiment includes formation of a thermal transfer image on the thermal transfer image-receiving layer by use of a transfer material such as an ink ribbon prior to the attachment of the image-receiving layer to intended types of substrates. The thermal transfer image-receiving layer 2 of the sheet as shown in FIG. 1 is first provided as shown in FIG. 8A. The layer 2 and a transfer material 6, which has an ink layer *6a* formed on a substrate *6b* and containing a cationic dye, are superposed such that the layer 2 and the ink layer *6a* are facing each other as shown in FIG. 8B.

Figure 8C:
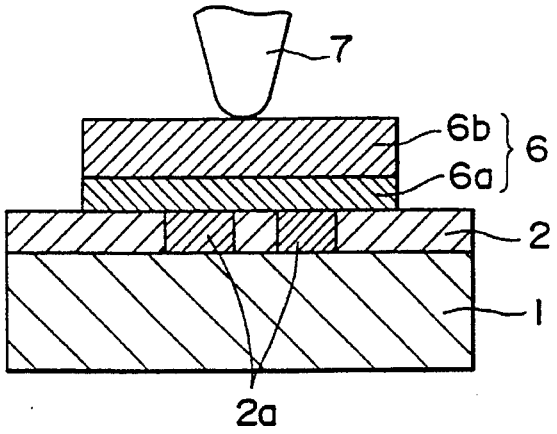
Figure 8D:
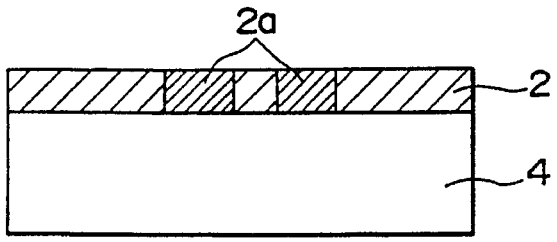

Subsequently, the transfer material 6 is selectively heated according to image signals by heating means such as, for example, a thermal head 7, thereby causing the cationic dye in the ink layer *6a* to be transferred to the image-receiving layer 2. Thus, a thermal transfer image *2a* is formed as shown in FIG. 8C. The cationic dye constituting the thermal transfer image *2a* is held and fixed with the layer compound in the receiving layer 2 through ion exchange reaction.

The image receiving layer-transferring sheet on which the thermal transfer image *2a* has been formed is used to transfer the image-bearing layer 2 to the substrate 4, on which the thermal transfer image *2a* is to be formed, according to any of the procedures of transferring the image-receiving layer illustrated in FIGS. 3A to 3C, 4A to 4C and 5A to 5C. This is particularly shown in FIG. 8D. It will be noted that if necessary, an adhesive layer or sheet may be provided between the substrate 4 and the thermal transfer image-receiving layer 2 as in the foregoing embodiments.

FIGS. 9A to 9D schematically show a procedure of forming a thermal transfer image on an intended type of substrate according to a still further embodiment of the invention.

Figure 9A:
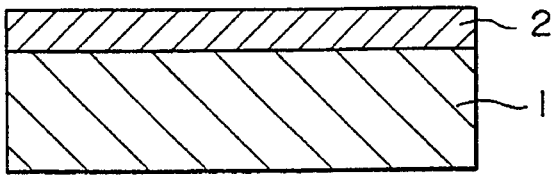
FIGS. 9A, 9B, 9C and 9D are, respectively, an illustrative view for a still further method of forming a thermal transfer image.
Figure 9B:
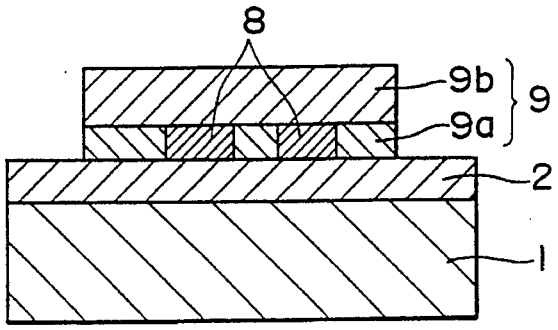

This embodiment comprises forming a thermal transfer image on an ordinary printing sheet, and re-transferring the image to a thermal transfer image-receiving layer of the sheet of the type shown in FIG. 1 prior to attachment of the receiving layer to an intended type of substrate. More particularly, the image-receiving layer 2 of the sheet shown in FIG. 1 is first provided. A printing sheet 9, which has an image-receiving layer *9a* formed on a synthetic paper *9b* and formed with a thermal transfer image 8 made of a cationic dye, is then superposed on the sheet of FIG. 1 so that the image-receiving layer *9a* and the layer 2 are facing each other as shown in FIG. 9B.

Figure 9C:
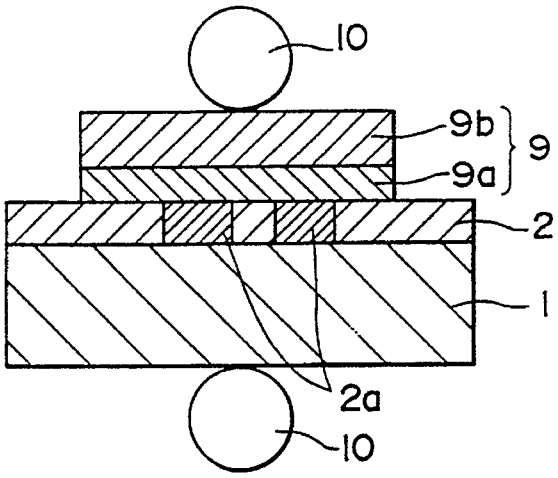
Figure 9D:
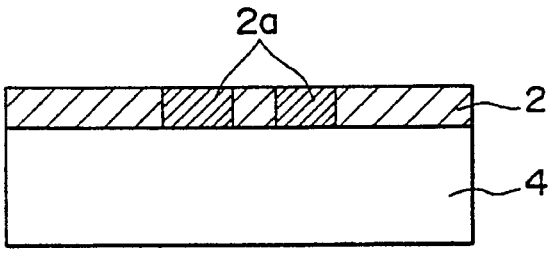

The superposed sheets are hot pressed such as by passage through heat rolls 10, thereby permitting the cationic dye of the thermal transfer image 8 from the image-receiving layer *9a* of the printing sheet 9 to be re-transferred to the layer 2 to form a thermal transfer image *2a* as shown in FIG. 9C. The thus re-transferred cationic dye is held and fixed with the layer compound in the layer 2 through ion exchange reaction therebetween.

Next, the sheet having the image-receiving layer 2 on which the thermal transfer image has been formed is used to transfer the image-bearing layer 2 to a substrate 4, on which the thermal transfer image *2a* is to be formed, according to any of the procedures set out hereinbefore with respect to FIGS. 3A to 3C, 4A to 4C and 5A to 5C. This is particularly shown in FIG. 8D. Like the foregoing embodiments, an adhesive layer or sheet may be provided between the substrate 4 and the layer, if necessary. Aside from the foregoing embodiments of the invention, the sheet of the invention capable of releasing the thermal transfer image-receiving layer therefrom may be used as a protective sheet for a printing sheet on which a thermal transfer image has been previously formed. In this case, the image-receiving layer 2 is transferred to and attached on an image-receiving layer of a printing sheet on which a thermal transfer image made of a cationic dye has been previously formed.

Figure 10:
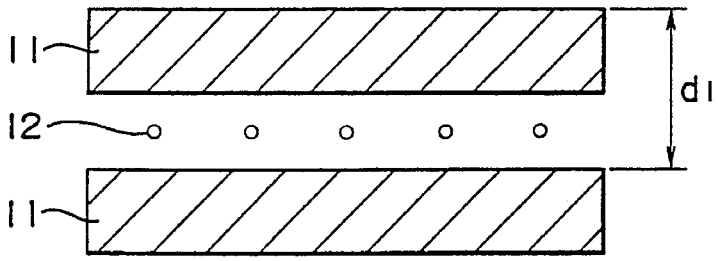
FIG. 10 is an illustrative view showing the structure of a non-treated layer compound.

The layer compound used in the present invention has a layer structure which has generally recurring units of a three-layer structure having a fundamental octahedron skeleton. In a non-treated and natural state, layer water and alkali metal ions which are ion exchangeable cations are held inbetween the respective layers. This is particularly shown in FIG. 10. A non-treated layer compound 11 has ion exchangeable sodium ions 12 between the layers thereof. The layer distance is taken as d1 as shown.

Figure 11:
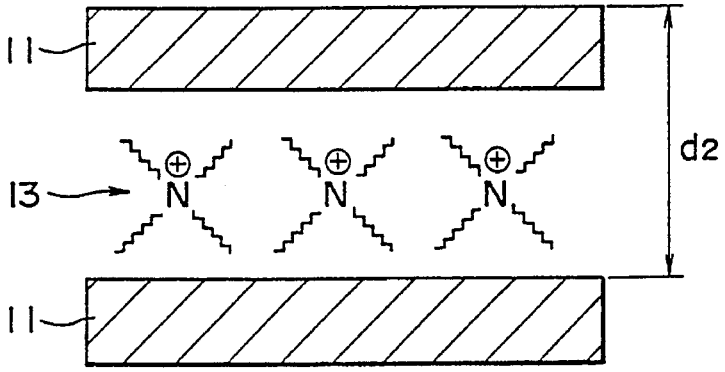
FIG. 11 is an illustrative view of the structure of a layer compound substituted with quaternary ammonium ions.
Figure 12:
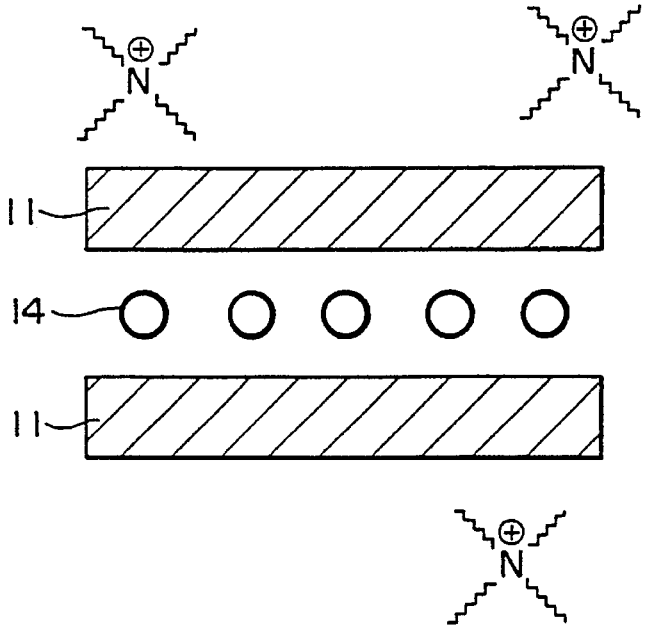
FIG. 12 is an illustrative view of the structure of a layer compound ion-exchanged with cationic dye molecules.

In the practice of the invention, it is preferred to use, as the layer compound, those compounds which have better ion exchangeability than non-treated compounds. More particularly, the layer compound 11 is swollen with water, to which organic cations such as quaternary ammonium ions 13 are added. By the addition, ion exchange takes place wherein the quaternary ammonium ions 13 are taken inbetween the layers instead of the sodium ions 12 as shown in FIG. 11. Owing to the presence of the quaternary ammonium ions 13 inbetween the layers, a layer distance d2 becomes larger than the layer distance d1 the non-treated layer compound. This permits better ion exchangeability with hydrophobic cationic dyes. The layer compound imparted with better ion exchangeability has the quaternary ammonium ions 13 having a hydrophobic chain held therein, so that when mixed with and dispersed in non-aqueous binder polymers, the compound swells.

When a thermal transfer image made of a hydrophobic cationic dye is formed on or in the thermal transfer image-receiving layer containing a swollen layer compound thereon, the hydrophobic cationic dye is miscible with the non-aqueous dye image-receiving layer and is taken in the respective layers of the layer compound. In the layers, ion exchange takes place between the quaternary ammonium ions 13 and a cationic dye 14. The cationic dye 14 which has been taken inbetween the layers of the layer compound 11 is ionically bonded to the layer compound 11 and securely fixed in the image-receiving layer. Accordingly, if the image-receiving layer in which the thermal transfer image made of the hydrophobic cationic dye has been formed is brought into contact with a material having a large quantity of plasticizer over a long time, the dye ionically bonded to the layer compound is prevented from transferring to the contacted material. Further, the solvent resistance of the cationic dye image can be drastically enhanced.

The invention is more particularly described by way of examples.

Example 1

20 g of synthetic saponite (available from Kunimine Ind. Co., Ltd. under the designation of Smecton SA) was provided as a layer compound and dispersed and swollen in one liter of water. Ethanol was added to the resultant dispersion in the same amount as that of the dispersion, followed by dropping 13.2 g (20 mg equivalents) of tetra-n-decylammonium bromide dissolved in 200 cc of ethanol under agitation. The mixture was allowed to stand over one week, whereupon granular coagulates or precipitates were settled down. The precipitates were separated from the dispersion by filtration and washed with a large amount of ethanol to remove unreacted quaternary ammonium salt therefrom. Subsequently, the thus washed precipitate was dried at room temperature under reduced pressure to obtain a purely white, hydrophobic powder of the layer compound.

The thus obtained layer compound and other ingredients were formulated as indicated in Table 1 and uniformly mixed by means of a jar mill to obtain a composition for forming a thermal transfer image-receiving layer. The composition was applied onto one side of a 50 μm thick polyethylene terephthalate release base sheet (available from Toray Co., Ltd. under the designation of S-10) in a dry thickness of about 10 μm by use of a wire bar, followed by drying with hot air of 120° C. for 2 minutes. Thus, a sheet capable of releasing a thermal transfer image-receiving layer therefrom was obtained.

TABLE 1

Formulation of A Composition for Forming A Thermal Transfer Image-receiving Layer

| Ingredients | Amount (Parts by Weight) |
|---|---|
| hydrophobic saponite | 10 |
| vinyl chloride-vinyl acetate copolymer (#1000D available from Denki Kagaku Kogyo Kabushiki Kaisha) | 10 |
| toluene | 65 |
| methyl ethyl ketone | 65 |

The thermal transfer image-receiving layer of the sheet was superposed on a currently employed PVC card (made by Dai Nippon Printing Co., Ltd.), followed by hot pressing by use of a hot press (MS-Pouch-H-140 available from Meiko Co., Ltd.) and separating the release base sheet therefrom to obtain a PVC card having the thermal transfer image-receiving layer thereon.

Separately, ink layer compositions comprising hydrophobic cationic dyes and having formulations indicated in Tables 2 to 4, respectively, were each applied in a dry thickness of about 1 μm onto a primer layer of a polyethylene terephthalate film (PET film) having a heat-resistant lubricating layer on a side opposite to the primer layer and dried with hot air of 120° C. for 2 minutes. As a result, yellow, cyan and magenta ink ribbons were, respectively, obtained.

TABLE 2

Formulation of A Composition for Forming A Yellow Ink Layer

| Ingredients | Amount (Parts by Weight) |
|---|---|
| C.I. Basic Yellow 28 Laurylsulfate | 110 |
| Polyvinyl butyral (6000CS available from Denki Kagaku Kogyo Kabushiki Kaisha) | 100 |
| Silicone resin (SF8427 available from Toray-Dow Corning Co., Ltd.) | 0.44 |
| toluene | 1250 |
| methyl ethyl ketone | 1250 |

TABLE 3

Formulation of A Composition for Forming A Magenta Ink Layer

| Ingredients | Amount (Parts by Weight) |
|---|---|
| C.I. Basic Red 22 Laurylsulfate | 80 |
| Polyvinyl butyral (6000CS available from Denki Kagaku Kogyo Kabushiki Kaisha) | 100 |
| Silicone resin (SF8427 available from Toray-Dow Corning Co., Ltd.) | 0.32 |
| toluene | 1250 |
| methyl ethyl ketone | 1250 |

TABLE 4

| Formulation of A Composition for Forming A Cyan Ink Layer | |
|---|---|
| Ingredients | Amount (Parts by Weight) |
| C.I. Basic Blue 75 Laurylsulfate | 150 |
| Polyvinyl butyral (6000CS available from Denki Kagaku Kogyo Kabushiki Kaisha) | 100 |
| Silicone resin (SF8427 available from Toray-Dow Corning Co., Ltd.) | 0.60 |
| toluene | 1250 |
| methyl ethyl ketone | 1250 |

The thus obtained ink ribbons were used to form a thermal transfer image on the thermal transfer image-receiving layer of the PVC card by use of a video printer for card.

The fixing properties of the thermal transfer image of the PVC card were tested and evaluated according to the following procedures.

Fixing Tests 1 to 3:

1. The thermal transfer image-receiving layer of the PVC card was allowed to stand for 14 days while keeping it in contact with an artificial leather made of polyvinyl chloride. Thereafter, it was visually observed and evaluated whether or not the dyes were re-transferred or migrated to the artificial leather and the thermal transfer image was damaged. The results are shown in Table 5. In the table, the mark "o" means the case where no dye was migrated to the artificial leather with the thermal transfer image suffering no change in appearance. The mark "x" means the case where dyes are migrated to the artificial leather and the thermal transfer image underwent some changes.
2. The image-received layer of the PVC card was contacted with toluene. Thereafter, it is visually evaluated whether or not the dyes are dissolved out in the toluene with the result that the image was impeded. The results are also shown in Table 5. In the table, the mark "o" indicates the case where no dye was dissolved out in toluene and the mark "x" indicates the case where the dyes were dissolved out in toluene with the image undergoing some changes.
3. The image-received layer of the PVC card was attached with a cyanoacrylate instantaneous adhesive. Then, it was visually evaluated whether or not the dyes were dissolved out in the adhesive and the thermal transfer image was eventually impeded. The results are shown in Table 5. In the table, the mark "o" indicates the case where the dyes were not dissolved out in the adhesive with the image suffering no change. The mark "x" indicates the case where the dyes were dissolved out in the adhesive with the image suffering some change.

TABLE 5

| | Fixing Test 1 (artificial Leather) | Fixing Test 2 (Toluene) | Fixing Test 3 (Instantaneous Adhesive) |
|---|---|---|---|
| Example 1 | o | o | o |
| 2 | o | o | o |
| 3 | o | o | o |
| 4 | o | o | o |

TABLE 5-continued

| | Fixing Test 1 (artificial Leather) | Fixing Test 2 (Toluene) | Fixing Test 3 (Instantaneous Adhesive) |
|---|---|---|---|
| Comparative Example 1 | x | x | x |
| Example 2 | x | x | x |

As will be apparent from the results of Table 5, the fixing properties of the thermal transfer image formed on the PVC card of this example were good.

Example 2

In the same manner as in Example 1, a thermal transfer image was formed on a currently employed PVC card of the type used in Example 1, on which the image-receiving layer bearing sheet as fabricated in Example 1 was used to transfer the receiving layer on the thermal transfer image as a protective layer. The firing properties of the thermal transfer image of the PVC card on which the protective layer was formed were tested and evaluated in the same manner as in Example 1. The results are shown in Table 5. As will be apparent from Table 5, the fixing properties of the thermal transfer image formed on the PVC card were good.

Comparative Example 1

A thermal transfer image was formed in the same manner as in Example 1 on a currently employed PVC card as used in Example 1. The thermal transfer image of the PVC card was subjected to fixing tests in the same manner as in Example 1. The results are shown in Table 5. As will be apparent from the table, the fixing properties of the thermal transfer image formed on the PVC card in this comparative example were not good.

EXAMPLE 3

A PVC card on which a thermal transfer image-receiving layer was formed or transferred was made in the same manner as in Example 1.

Separately, ink ribbons as used in Example 1 were employed to form a thermal transfer image on a currently employed printing sheet having a cellulose image-receiving layer (VPM-30 STA available from Sony Corporation).

The thermal transfer image-receiving layer of the PVC card and the image-received layer of the printing sheet were superposed, followed passage through a hot pressing device (MS-Pouch H-140 available from Meiko Co., Ltd.) so that the cationic dyes in the image-received layer of the printing sheet were re-transferred to the image-receiving layer of the PVC card, thereby forming a thermal re-transfer image on the PVC card. The thermal re-transfer image of the PVC card was tested and evaluated in the same manner as in Example 1 with respect to the fixing properties of the thermal re-transfer image. The results are shown in Table 5. As will be apparent from Table 5, the fixing properties of the thermal transfer image formed on the PVC card were good.

Comparative Example 2

A thermal transfer image was formed in the same manner as in Example 3 on a currently employed PVC card as used in Example 1. The fixing properties of the thermal transfer image of the PVC card were tested and evaluated in the same manner as in Example 1. The results are shown in Table 5. As will be apparent from Table 5, the firing properties were not good.

Example 4

The general procedure of Example 1 was repeated using, instead of the polyethylene terephthalate release base sheet, a 110 μm thick white polyethylene terephthalate substrate, to obtain a sheet capable of releasing a thermal transfer image-receiving layer therefrom which was usable as a printing sheet.

The thermal transfer image-receiving layer of the sheet was formed with a thermal transfer image in the same manner as in Example 1.

The image-bearing layer of the sheet and a currently employed PVC card were superposed. Then, the image-bearing layer was transferred on the PVC card in the same manner as Example 1, followed by separating the pearl base sheet to obtain a thermal transfer image-bearing PVC card. The fixing properties of the thermal transfer image on the PVC card were tested and evaluated in the same manner as in Example 1. The results are shown in Table 5. As will be apparent from Table 5, the firing properties of the image formed on the PVC card were good.

Example 5

The sheet capable of releasing an image-receiving layer fabricated in Example 1 was superposed at the side of the image-receiving layer with an adhesive sheet (HItachi Video Print Kit available from Hitachi Ltd.), followed by hot pressing (MS-Pouch H-140 available from Meiko Co., Ltd.) to form the adhesive sheet layer on the thermal transfer image-receiving layer.

Separately, a thermal transfer image was formed on a printing sheet in the same manner as in Example 3.

Next, the release base sheet was removed from the sheet capable of releasing the receiving layer. Then, the adhesive sheet layer was provided on a 100% cotton cloth whereas the thermal transfer image of the printing sheet was placed on the thermal transfer image-receiving layer exposed by the removal of the sheet, followed by heating with a warm iron. By this, the thermal transfer image-receiving layer was bonded to the cloth and the thermal transfer image of the printing sheet was re-transferred to the exposed image-receiving layer. Thus, the cloth had the thermal transfer image thereon.

The fixing properties of the image on the cloth were tested and evaluated in the following procedures.

Fixing Tests 4 and 5

4. The cloth was immersed for 30 seconds in perchloroethylene, which was ordinarily used as a solvent for dry cleaning. Then, it was visually observed and evaluated whether or not the dyes were dissolved out in perchloroethylene with the thermal transfer image being damaged. The results are shown in Table 6. In the table, the mark "o" indicates the case where the dyes were not dissolved out in perchloroethylene without any change of the thermal transfer image. The mark "x" indicates the case where the dyes were dissolved out in perchloroethylene and the image underwent some changes.
5. Iron balls and the doth were placed in perchloroethylene and mixed in a jar mill for 3 hours. Thereafter, it was visually observed and evaluated whether or not the dyes were dissolved out in perchloroethylene and the thermal transfer image was damaged. The results are shown in Table 6. In the table, the mark "o" indicates the case where the dyes were not dissolved out in perchloroethylene without any change of the thermal transfer image. The mark "x" indicates the case where the dyes were dissolved out in perchloroethylene and the image underwent some changes.

TABLE 6

| | Fixing Test 4 (immersion) | Fixing Test 5 (jar milling) |
|---|---|---|
| Example 5 | o | o |
| 6 | o | o |
| Comparative Example 3 | x | x |

As will be apparent from Table 5, the fixing properties of the thermal transfer image formed on the doth were good.

EXAMPLE 6

The general procedure of Example 1 was repeated except that there was used, instead of the polyethylene terephthalate release base sheet, a 110 μm thick white polyethylene terephthalate substrate as in Example 4, thereby obtaining a sheet capable of releasing an image-receiving layer therefrom and usable as a printing sheet.

The image-receiving layer of the thus obtained sheet was formed with a thermal transfer image in the same manner as in Example 1.

The image-bearing layer of the sheet and a cloth sheet were superposed while sandwiching an adhesive sheet (Hitachi Video Print Kit available from Hitachi Ltd.) therebetween, followed by hot pressing by use of a hot press (MS-Pouch H-140 available from Meiko Co., Ltd.) to bond the image-bearing layer to the doth sheet. Finally, the pearl substrate was peeled off to form the thermal transfer image on the cloth.

The image of the cloth was tested and evaluated in the same manner as in Example 5 with respect to the fixing properties of the image. The results are shown in Table 6. As will be apparent from Table 6, the fixing properties of the image on the doth were good.

Comparative Example 3

A thermal transfer image was formed on a printing sheet in the same manner as in Example 3. The thermal transfer image was re-transferred from the printing sheet to a doth by use of a commercially available printing kit (HItachi Video Print Kit of Hitachi Ltd.). The fixing properties of the thermal transfer image of the cloth were similarly tested and evaluated. The results are shown in Table 6. The results of Table 6 reveal that the thermal transfer image formed on the doth was not satisfactory with respect to the fixing properties.

As will be apparent from the foregoing, the sheet and methods of the invention which are adapted for the formation of images according to the thermal transfer systems ensure improved fixing properties of cationic dyes in image-receiving layers. Moreover, the image-receiving layer, on which an intended thermal transfer image has been formed or not formed yet, can be readily transferred and bonded to various types of substrates such as PVC cards, cloths and the like.

What is claimed is:

1. An image transfer sheet comprising a release base sheet having a thermal transfer image-receiving layer formed thereon and which is capable of releasing the thermal transfer image-receiving layer therefrom, said receiving layer including a dispersion of a resin binder and a dye-fixing amount of a layer compound capable of fixing cationic dyes through ion exchange reaction therewith, said layer compound being selected from the group consisting of: montmorillonite, magnesium montmorillonite, iron montmorillonite, iron magnesium montmorillonite, heidellite, aluminum heidellite, nontronite, aluminum nontronite, saponite, aluminum saponite, hectorite, sauconite, halogen-substituted compounds of any of the foregoing, sodium silicic mica, sodium taeniolite and lithium taeniolite, cation exchangeable alkali metal cations and alkaline earth metal cations in said layer compound having been replaced by organic cations selected from the group consisting of alkyl-substituted-quarternary ammonium ions and alkyl-substituted phosphonium ions, wherein said alkyl group substituents have not less than 8 carbon atoms.

2. The sheet according to claim 1, wherein said resin binder is a thermoplastic resin which exhibits adhesiveness on hot pressing.

3. The sheet according to claim 1, further comprising an adhesive layer on said receiving layer.

4. The sheet according to claim 1, wherein said layer compound is present in an amount of 10 to 90 wt % of said receiving layer.

5. A method for transferring a thermal transfer image-receiving layer from an image transfer sheet to a substrate comprising the steps of:

providing a transfer sheet of the type including a release base sheet and a thermal transfer image-receiving layer formed on the release base sheet, said image-receiving layer being a dispersion including a resin binder and a dye-fixing amount of a layer compound capable of fixing cationic dyes through ion exchange reaction therewith, said layer compound being selected from the group consisting of: montmorillonite, magnesium montmorillonite, iron montmorillonite, iron magnesium montmorillonite, heidellite, aluminum heidellite, nontronite, aluminum nontronite, saponite, aluminum saponite, hectorite, sauconite, halogen-substituted compounds of any of the foregoing, sodium silicic mica, sodium taeniolite and lithium taeniolite, cation exchangeable alkali metal cations and alkaline earth metal cations in said layer compound having been replaced by organic cations selected from the group consisting of alkyl-substituted quarternary ammonium ions and alkyl-substituted phosphonium ions, wherein said alkyl group substituents have not less than 8 carbon atoms;

superposing the image transfer sheet on a substrate, on which a thermal transfer image is to be formed in such a way that said image-receiving layer is in face-to-face relation with the substrate; and peeling off the release base sheet from the image transfer sheet.

6. The method according to claim 5, further comprising superposing said image-receiving layer formed on said substrate on an ink layer of a transfer material containing at least one cationic dye, selectively heating the transfer material according to image signals thereby causing the cationic dye in the transfer material to said image-receiving layer in an imagewise pattern whereby the cationic dye is fixed in said image-receiving layer through ion exchange reaction with the layer compound contained in said image-receiving layer.

7. The method according to claim 5, further comprising superposing an image-receiving layer of a printing sheet, on which a thermal transfer image made of a cationic dye has been formed, on said thermal transfer image-receiving layer, and hot pressing the superposed layers to re-transfer the cationic dye image on said thermal transfer image-receiving layer thereby causing the cationic dye image to fix through ion exchange reaction with the layer compound in said thermal transfer image-receiving layer.

8. A method for forming a thermal transfer image on a substrate comprising the steps of:

providing a release base sheet having a thermal transfer image-receiving layer thereon, said thermal transfer image-receiving layer including a dispersion of a resin binder and a dye-fixing amount of a layer compound capable of fixing a cationic dye through ion exchange reaction therewith, said layer compound being selected from the group consisting of: montmorillonite, magnesium montmorillonite, iron montmorillonite, iron magnesium montmorillonite, heidellite, aluminum heidellite, nontronite, aluminum nontronite, saponite, aluminum saponite, hectorite, sauconite, halogen-substituted compounds of any of the foregoing, sodium silicic mica, sodium taeniolite and lithium taeniolite, cation exchangeable alkali metal cations and alkaline earth metal cations in said layer compound having been replaced by organic cations selected from the group consisting of alkyl-substituted quarternary ammonium ions and alkyl-substituted phosphonium ions, wherein said alkyl group substituents have not less than 8 carbon atoms;

superposing said thermal transfer image-receiving layer with an ink layer of a transfer material which contains a cationic dye therein;

selectively heating the transfer material according to image signals thereby causing the cationic dye in the ink layer to be transferred to said thermal transfer image-receiving layer in an imagewise pattern and fixing the resultant cationic dye image through ion exchange reaction with the layer compound in said thermal transfer image-receiving layer; and transferring the fixed dye image-bearing layer to a substrate.

9. The method according to claim 8, wherein said fixed dye image-bearing layer is bonded to said substrate by hot pressing.

10. A method for forming a thermal transfer image on a substrate, the method comprising the steps of:

providing a transfer sheet including a release base sheet having a thermal transfer image-receiving layer thereon, the thermal transfer image-receiving layer including a dispersion of a resin binder and a dye-fixing amount of a layer compound capable of fixing a cationic dye through ion exchange reaction therewith, said layer compound being selected from the group consisting of: montmorillonite, magnesium montmorillonite, iron montmorillonite, iron magnesium montmorillonite, heidellite, aluminum heidellite, nontronite, aluminum nontronite, saponite, aluminum saponite, hectorite, sauconite, halogen-substituted compounds of any of the foregoing, sodium silicic mica, sodium taeniolite and lithium taeniolite, cation exchangeable alkali metal cations and alkaline earth metal cations in said layer compound having been replaced by organic cations selected from the group consisting of alkyl-substituted quarternary ammonium ions and alkyl-substituted phosphonium ions, wherein said alkyl group substituents have not less than 8 carbon atoms;

superposing said thermal transfer image-receiving layer on an image-receiving layer of a printing sheet, on which a thermal transfer image made of a cationic dye has been formed;

selectively hot pressing the superposed layers to retransfer the cationic dye thermal transfer image to the thermal transfer image-receiving layer wherein the cationic dye thermal transfer image is fixed through ion exchange reaction with the layer compound in said thermal transfer image-receiving layer; and transferring the image-bearing layer to a substrate on which the image is to be formed.

* * * * *